US005579089A

United States Patent [19]

Folkins

[11] Patent Number: 5,579,089

[45] Date of Patent: Nov. 26, 1996

[54] METHOD AND APPARATUS FOR REDUCING TRANSFERRED BACKGROUND TONER

[75] Inventor: Jeffrey J. Folkins, Rochester, N.Y.

[73] Assignee: Xerox Corporation, Stamford, Conn.

[21] Appl. No.: 346,708

[22] Filed: Nov. 30, 1994

[51] Int. Cl.[6] ..... G03G 15/00

[52] U.S. Cl. ..... 355/208; 355/219

[58] Field of Search ..... 355/208, 219, 355/326 R, 327, 214, 216, 225, 246; 347/118

[56] References Cited

U.S. PATENT DOCUMENTS

| | | | |
|---|---|---|---|
| 4,033,688 | 7/1977 | Orthmann . | |
| 4,660,059 | 4/1987 | O'Brien | 355/259 |
| 4,761,669 | 8/1988 | Langdon . | |
| 4,791,452 | 12/1988 | Kasai et al. . | |
| 4,819,028 | 4/1989 | Abe | 347/118 |
| 4,828,953 | 5/1989 | Oka et al. | 430/100 |
| 4,833,503 | 5/1989 | Snelling | 355/259 |
| 4,860,048 | 8/1989 | Itoh et al. | 355/208 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,438,401 | 8/1995 | Murayama et al. | 355/326 R |

FOREIGN PATENT DOCUMENTS

| | | |
|---|---|---|
| 1-340663 | 9/1991 | Japan . |

*Primary Examiner*—Thu A. Dang

[57] ABSTRACT

In a multi-color imaging apparatus utilizing a recharge step between two image creation steps for conditioning a charge retentive surface pursuant to forming the second of the two images, a corona generating device is used to both charge the toned and untoned areas of the charge retentive surface, and to keep wrong-charge toner developed in the background areas at a charge level distinct from the toner developed in the image areas, so that the wrong-charge background toner does not transfer to a support substrate with the image.

2 Claims, 4 Drawing Sheets

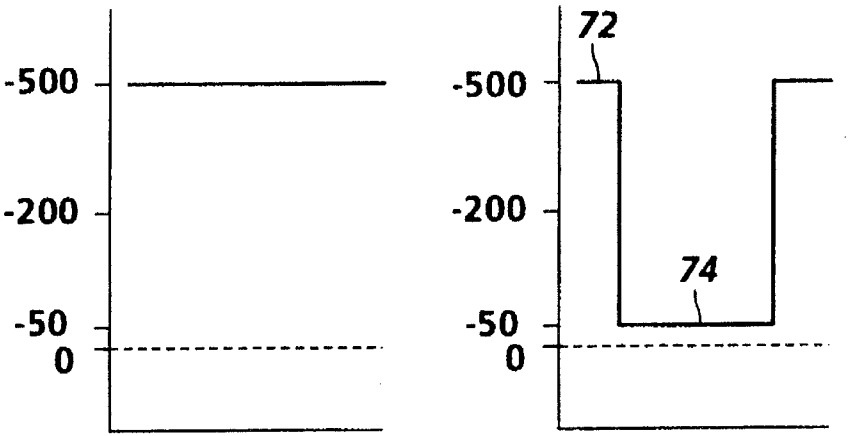
FIG. 4A
FIG. 4B
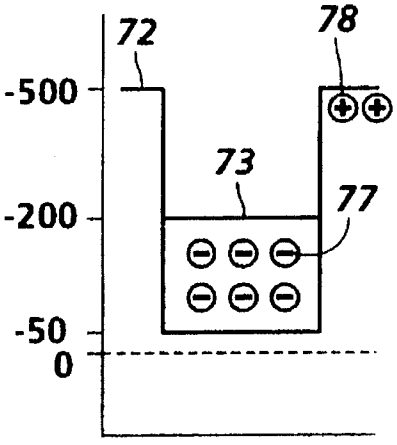
FIG. 4C
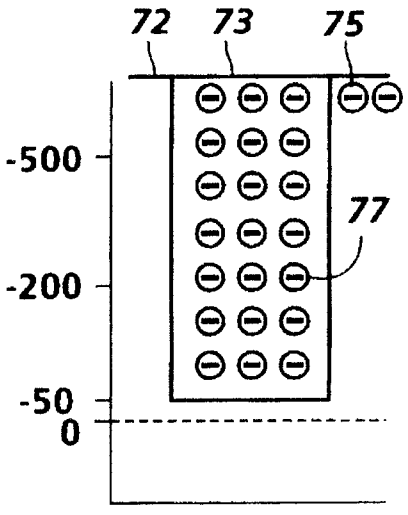
FIG. 4D

METHOD AND APPARATUS FOR REDUCING TRANSFERRED BACKGROUND TONER

BACKGROUND OF THE INVENTION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop (REaD) process may be repeated to subsequently develop images of different colors on the surface before the full color image is subsequently transferred to a support substrate. The different colors may be developed on the photoreceptor in an image on image development process, or a highlight color image development process (image next-to image). The images may be formed using by a single exposure device, e.g. ROS, where each subsequent color image is formed during a subsequent pass of the photoreceptor (multiple pass). Alternatively, each different color image may be formed by multiple exposure devices corresponding to each different color image, during a single revolution of the photoreceptor (single pass).

In any development system it is very difficult to have 100% purely charged toner, i.e. toner that contains all particles having relatively the same charge level, for developing in the image areas of the photoreceptor. The majority of toner particles in a development system will be at relatively the same charge level, however there is typically the presence of some toner and debris particles having associated charge levels that vary from a moderate to an extreme amount (hereinafter referred to as "wrong-charge" toner) from the charge level of the majority of toner particles, including some toner particles with a charge level polarity which is opposite from the majority. Many factors contribute to the presence of this wrong-charge toner in a development system, including the humidity level, the toner concentration level, and the age, design and overall manufactured quality of the developer material.

The charges associated with the background areas of the photoreceptor are at a much higher or lower level (depending on whether charge area development or discharge area development is being used) relative to the image areas, and therefore the background areas are likely to attract this wrong-charge toner. Thus, a common defect for development systems is the development of this wrong-charge toner in the background non-image areas of the photoreceptor. Since the recharge device sprays charge on both the toned areas and the background areas having wrong-charge toner, transferability of the toner on both of these areas is affected.

In the method of creating multi-color images using the REaD process, the development of subsequent color images onto previously developed images creates a unique set of issues to be addressed. For example, during a recharge step, it is important to level the voltage among previously toned and untoned areas so that subsequent exposure and development steps are effected across a uniformly charged surface. The greater the difference in voltages between a bare photoreceptor area and a toned photoreceptor area following a recharge step, the larger will be the difference in the development potential between the two areas.

In an attempt to achieve optimum conditions for the development of subsequent images onto previously developed images, the operating conditions during recharging often cause wrong-charge background toner and debris to recharge to a level more commensurate with the charge level associated with the toned image. Subsequently, during transfer, the background toner now having a similar charge to the image toner transfers to the support substrate with the toned image, thereby impairing image quality. For example, if the image areas comprise negatively charged toner, and positively charged (wrong-charge) toner is developed onto background areas, during the recharge step, this positive toner may become negatively charged. All toners having a negative charge are then attracted to a support substrate during the transfer step. The transfer of the background toner causes undesirable spots and/or gray areas on the support substrate where clear white background is otherwise desired.

Based on the foregoing, a reliable and consistent manner of recharging the photoreceptor is needed so that the occurrence of transferred background toner is minimized.

The following references may be found relevant to the present disclosure.

U.S. Pat. No. 4,791,452 relates to two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second corona charger unit for charging the surface of the photoconductive drum after the first visible image is formed thereon so as to increase the surface potential of the photoconductive drum to prevent the first visible image from being mixed with a second color and also from being scratched off from the surface of the photoconductive drum by a second magnetic brush developing unit.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image.

U.S. Pat. No. 4,033,688 discloses a color copying apparatus which utilizes a light-tens scanning device for creating plural color images. This patent discloses multiple charge/expose/develop steps.

U.S. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

Application No. Hei 1-340663, Application date Dec. 29, 1989, Publication date Sep. 4, 1991, assigned to Matsushita Denki Sangyo K. K., discloses a color image forming apparatus wherein a first and second charging device are used before exposure and development of an image, where the potential of the image forming unit is higher after passing the first charging device than after passing the second charging device, to eliminate the contrast potential reduction normally caused by applying color toners onto other color toners, and also to prevent toner spray during the exposure process.

The concurrently filed, copending application for patent entitled "Method and Apparatus for Reducing Residual Toner Voltage", Ser. No. (D/92483), by a common assignee as the present application, discloses a voltage sensitive recharge device used for the recharging steps during a color image formation, whose graph of the output current (I) to the charge retentive surface as a function of the voltage to the charge retentive surface (V) has a high (I/V) slope. The high I/V slope recharge device disclosed having an AC voltage supplied thereto, enables an extended time for neutralization to occur at the top of the toner layers.

The concurrently filed, copending application for patent entitled "Split Recharge Method and Apparatus for Color Image Formation ", Ser. No. (D/92485), by a common assignee as the present application, discloses a recharge step between two image creation steps for recharging a charge retentive surface to a predetermined potential pursuant to forming the second of the two images. A first corona generating device recharges the charge retentive surface to a higher absolute potential than a predetermined potential, and then a second corona generating device recharges the charge retentive surface to the predetermined potential. An electrical charge associated with the first image is substantially neutralized after being recharged by the first and second corona generating device.

A number of commercial printers employ the recharge/expose/and develop color image formation process. For example, the Konica 9028, a multi-pass color printer forms a single color image during each pass of the photoreceptor. Each such pass utilizes a recharge step following development of each color image. The Panasonic FPC1 machine, like the Konica machine is a multi-pass color device. In addition to a recharge step the FPC 1 machine employs an AC corona discharge device prior to recharge.

SUMMARY OF THE INVENTION

In accordance with one aspect of the invention, a printing machine is disclosed, comprising a charge retentive surface having a non-image area of a first voltage level, and a developed image area of a second voltage level; and a corona generating device for recharging the charge retentive surface to a voltage level intermediate the first voltage level and the second voltage level.

In accordance with another aspect of the invention, a method for creating an image on a charge retentive surface is disclosed, comprising the steps of charging the charge retentive surface to a first voltage level, exposing the charge retentive surface to record an image area, developing the image areas to form a developed image area at a second voltage level with a non-image area being at the first voltage level, and recharging the charge retentive surface to a voltage level intermediate the first voltage level and the second voltage level.

BRIEF DESCRIPTION OF THE DRAWINGS

FIG. 4A shows the photoreceptor voltage profile after a uniform charging step of a DAD image formation process of the prior art;

FIG. 4B shows the photoreceptor voltage profile after an exposure step of a DAD image formation process of the prior art;

FIG. 4C shows the photoreceptor voltage profile after a development step of a DAD image formation process of the prior art; and FIG. 4D shows the photoreceptor voltage profile after a recharging step of a DAD image formation process of the prior art.

DETAILED DESCRIPTION OF THE INVENTION

This invention relates to an imaging system which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system having a single exposure device, as well as a single or multiple pass highlight color system. Furthermore, although the embodiment disclosed is directed to a negatively charged photoreceptor developed with negatively charged toner using discharged area development, it is understood that the invention disclosed is applicable to a positively charged photoreceptor, positively charged toner, and/or the use of charged area development. Although the image toner and background toner are described in the following embodiment as being opposite in polarity, it is also understood that background wrong-charge toner transfer would also likely occur without the implementation of the present invention as hereinafter described, where both the image toner and background toner are of the same polarity yet have respectively different and distinct charge levels associated therewith.

Figure 1:
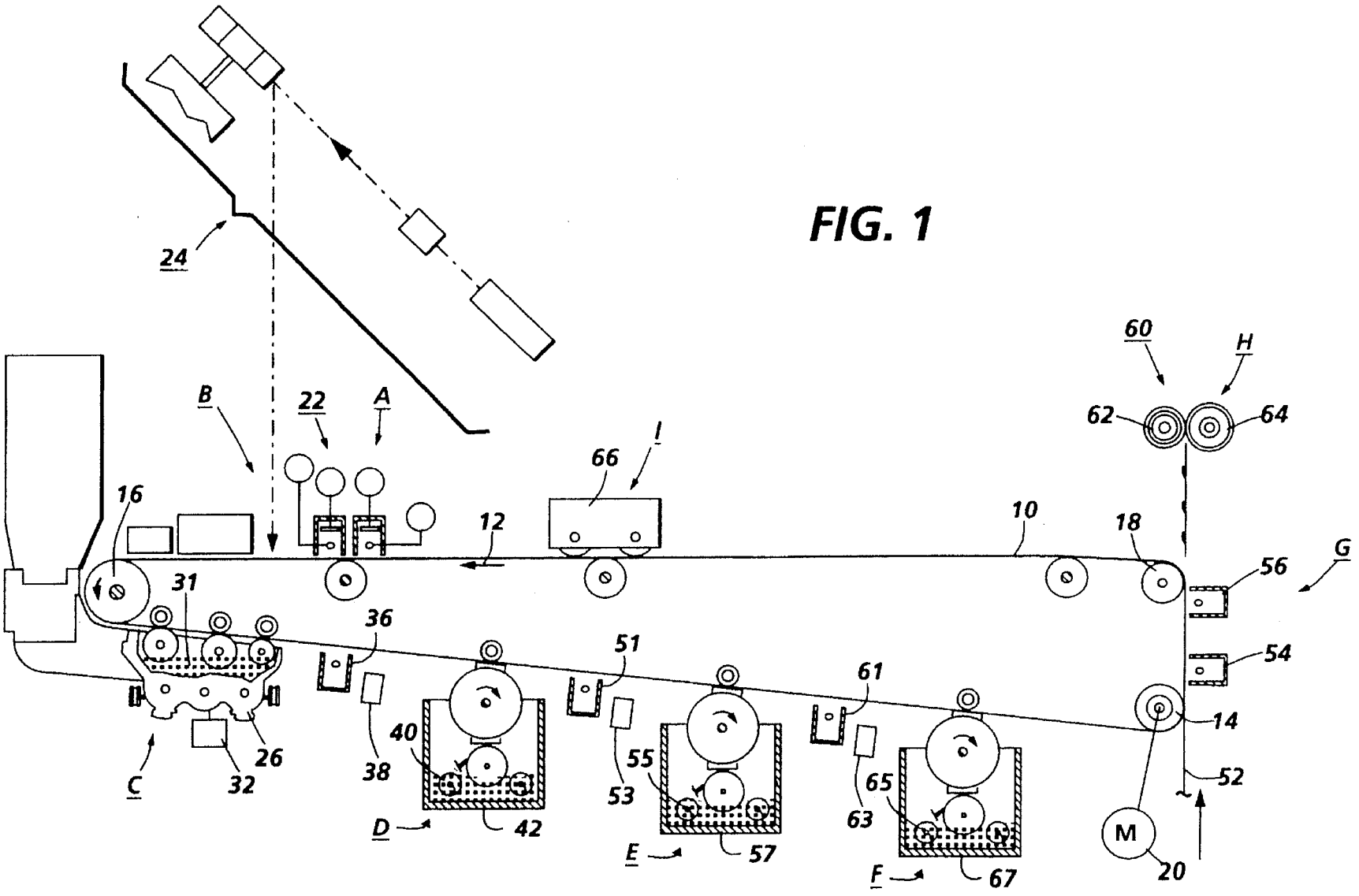
FIG. 1 is schematic illustration of an imaging apparatus incorporating the recharging features of the development system of the invention.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Alternatively, the ROS could be replaced by other xerographic exposure devices known in the art.

The photoreceptor, which is initially charged to a voltage $V_0$, undergoes dark decay to a level $V_{ddp}$ equal to about −500 volts. When exposed at the exposure station B it is discharged to $V_{DAD}$ equal to about −100 volts. Thus after exposure, the photoreceptor contains a monopolar voltage profile of high and low voltages, the former corresponding to charged background areas and the latter corresponding to discharged or image areas.

At a first development station C, a magnetic brush developer structure, indicated generally by the reference numeral 26 advances insulative magnetic brush (IMB) material 31 into contact with the electrostatic latent image, $V_{DAD}$. The development structure 26 comprises a plurality of magnetic brush roller members. These magnetic brush rollers present, for example, negatively charged black toner material to the discharged image areas for development thereof. Appropriate developer biasing is accomplished via power supply 32. Electrical biasing is such as to effect discharged area development (DAD) of the lower of the two negative voltage levels on the photoreceptor with the material 31. During this first development step, black colored toner adheres to the DAD image area and causes the photoreceptor in the image area to be increased to approximately −250 volts. Thus, a voltage difference of −250 volts exists between the toned (−250 volts) and untoned (−500 volts) areas of the photoreceptor.

A corona recharge device 36 recharges both the toner image areas and the background areas of the photoreceptor to a voltage level of −475 volts, which is between the toner voltage level associated with the developed image (−250 volts) and the charged background level (−500 volts). This intermediate recharge voltage level ensures that any developed wrong-charge toner in background areas does not significantly alter its charge level to become closer to the charge level associated with the image toner, and in the present example, ensures that the wrong-charge background toner remains of an opposite polarity to the polarity of the developed toner in the image areas, thereby preventing the possibility of transfer of this background toner to a final support substrate. Thus any positively charged wrong-charge toner found in the background areas remains positive, as the net charge applied to the background areas is +25 volts, whereas the image areas remain negatively charged to −475 volts. The recharging device 36 serves to both recharge the photoreceptor to a predetermined intermediate voltage level, and to minimize the voltage difference between toned areas and bare untoned areas to within acceptable limits for subsequent imaging and development of different color toner images on both of these areas of the photoreceptor.

The difference of 25 volts from the original charge of the background level (−500 volts) and the recharge voltage level of the background areas and image areas of the photoreceptor (−475 volts), represents an exemplary intermediate voltage level position which has demonstrated a substantial elimination of background toner transfer occurrence. However, it is understood that variations of this voltage difference can be used to obtain favorable results of a reduced background toner transfer occurrence, based on varying machine conditions. For example, a voltage difference in the range of 5 to 75 volts from the original background charge level may be found to produce favorable results for the substantial elimination of background toner transfer occurrence.

The corona recharge device 36 of the present invention may be of the scorotron type, having a voltage supplied by power supply (not shown) to both a corona generating electrode, and a voltage control surface. Furthermore, the corona recharge device 36 may be a scorotron having a high output current vs. control surface voltage (I/V) characteristic slope, the operating conditions of which are pre-selected to produce the desired high I/V characteristic slope. A high I/V slope device used for the recharge step correlates with substantial voltage uniformity between previously toned and untoned areas of the photoreceptor after recharge, and is described in the concurrently filed application for U.S. patent application Ser. No. (D/92483), filed by a common assignee on the same date as the present application. The intermediate level recharge device of the present invention is described in further detail with reference to FIGS. 2A–4D.

Figures 2A, 2B, 2C, 2D:
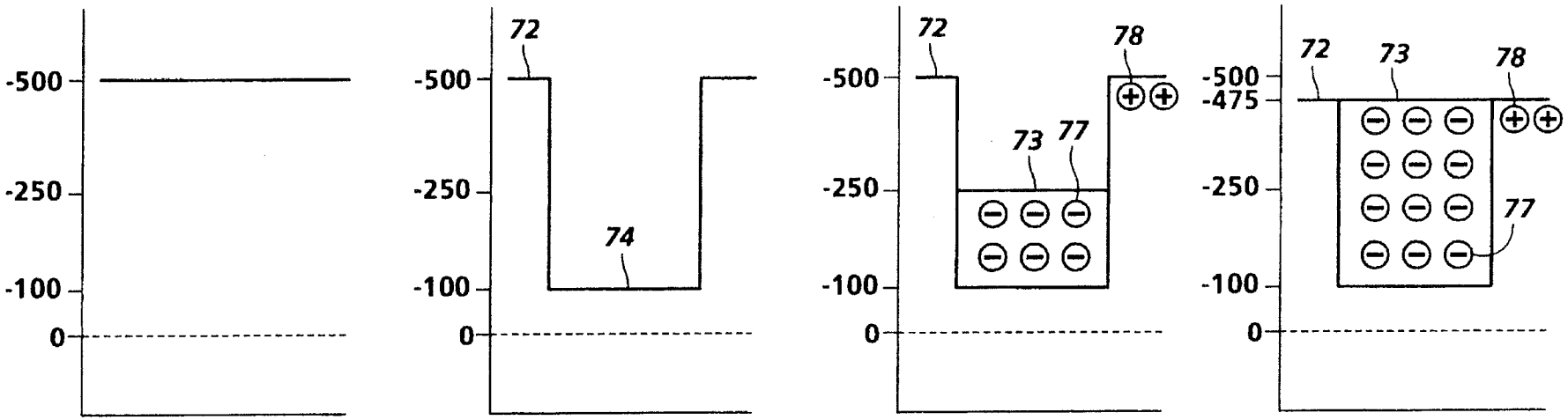
FIG. 2A shows the photoreceptor voltage profile after a uniform charging step of a DAD image formation described with reference to FIG. 1.
FIG. 2B shows the photoreceptor voltage profile after an exposure step of a DAD image formation described with reference to FIG. 1.
FIG. 2C shows the photoreceptor voltage profile after a development step of a DAD image formation described with reference to FIG. 1.
FIG. 2D shows the photoreceptor voltage profile after a recharging step of a DAD image formation described with reference to FIG. 1.

A second exposure or imaging device 38 which may comprise a laser based output structure is utilized for selectively discharging toned areas and/or bare areas of the photoreceptor to approximately –75 volts, pursuant to the image areas to be developed with the second color developer. After this point, the photoreceptor contains toned and untoned areas at relatively high voltage levels (–475 volts) and toned and untoned areas at relatively low voltage levels (–75 volts). These low voltage areas represent image areas which will be developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by a non-interactive developer. A power supply (not shown) serves to electrically bias the developer structure to a level effective to develop the DAD image areas with negatively charged yellow toner particles 40. During this second development step, the yellow colored toner adheres to the DAD image area and causes the photoreceptor in the image area to be negatively increased to approximately –275 volts (FIG. 2C). Thus, a voltage difference of –200 volts exists between the toned 73 (–275 volts) and untoned 74 (–475 volts) areas of the photoreceptor.

A corona recharge device 51 conditions both the toned and untoned areas of the photoreceptor, by recharging both these areas of the photoreceptor to a predetermined voltage level of –450 volts, which is between the toner layer voltage level (–275 volts) and the charged area background voltage level (–475 volts). This intermediate level recharge step ensures that the wrong-charge background toner does not significantly alter its charge level to become closely associated with the image toner charge level, and in the present example, ensures that the wrong-charge background toner does not reverse its polarity and become the same sign polarity as that toner in the image areas. The transfer of the background toner to a support substrate during image transfer is thereby prevented. Thus any positively charged wrong-charge toner found in the background areas remains positive, as the net charge applied to this background area is 25 volts. The corona recharge device 51 also minimizes the voltage differential between the previous toned layer(s) and the untoned background areas. The photoreceptor is then at a substantially uniform potential between bare areas and toned areas, in preparation for the creation of the third color image. The corona recharge device 51 may be of the scorotron type, having a voltage supplied by power supply (not shown) to both a corona wire and a grid. The intermediate level recharge device 51 which is the subject of the present invention, is described in further detail with reference to FIGS. 2A–2D.

A third latent image is created using an imaging or exposure member 53. In this instance, a second DAD image is formed, discharging both bare areas of the photoreceptor and toned areas of the photoreceptor to approximately –50 volts. This discharged area is to be developed with the third color image. This image is developed using a third color toner 55 contained in a non-interactive developer housing 57 at a third development station E. An example of a suitable third color toner is magenta. Suitable electrical biasing of the housing 57 is provided by a power supply, not shown. During this third development step, the magenta colored toner adheres to the discharged image area and causes the photoreceptor in the image area to be increased to approximately –250 volts. Thus, a voltage difference of –200 volts exists between the toned 73 (–250 volts) and untoned 74 (–450 volts) areas of the photoreceptor.

A corona recharge device 61 recharges both the toned and untoned areas of the photoreceptor to a predetermined voltage level of –425 volts, which is between the toner layer voltage level (–250 volts) and the charged area background voltage level (–450 volts). This intermediate level recharge step ensures that the wrong-charge background toner does not significantly alter its charge level to become closely associated with the image toner charge level, and in the present example, ensures that the wrong-charge background toner does not reverse its polarity and become the same sign polarity as that toner in the image areas. The transfer of the background toner to a support substrate during image transfer is thereby prevented. Thus any positively charged wrong-charge toner found in the background areas remains positive, as the net charge applied to this background area is +25 volts.

An imaging or exposure member 63 discharges those bare areas and previously developed areas of the photoreceptor to be developed with the fourth color toner to approximately –25 volts in a fourth development station F. An example of a suitable fourth color toner is cyan. During this fourth development step, the cyan colored toner adheres to the discharged image area and causes the photoreceptor in the image areas to be negatively increased to approximately –225 volts. Thus, a voltage difference of –200 volts exists between the toned 73 (–225 volts) and untoned 74 (–425 volts) areas of the photoreceptor.

The developer housing structures 42, 57 and 67 are preferably of the type known in the art which are non-interactive or only marginally interactive with previously developed images. For example, a non-interactive, scavengeless development housing having minimal interactive effects between previously deposited toner and subsequently presented toner is described in U.S. Pat. No. 4,833,503, the relevant portions of which are hereby incorporated by reference herein. Other types of development systems suitable for use with the present invention are, for example, a DC jumping development system, a soft magnetic brush, or a sparse non-contacting magnetic brush development system.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer corona device 54 which sprays positive ions onto the backside of support substrate or sheet 52. This attracts the negatively charged toner powder images from the belt 10 to sheet 52 and repels the positively charge background toner from the sheet 52, thereby preventing transfer of any wrong-charge background toner to the sheet with the image. A detack corona device 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

The corona recharge devices 36, 51 and 61 have been described with reference to FIG. 1 for purposes of example as a scorotron type. However, it is understood that a corona generating device for use in the present invention could be in the form of, for examples, a dicorotron, a pin scorotron, or other recharge devices known in the art. The corona recharge device of the present invention may apply a direct current (DC) charge, however, an alternating current (AC) bi-polar device is preferred so that the ions of the same polarity charge as the wrong charge background toner will spray onto background areas, and those ions with the same polarity charge as the toner image (and opposite from the background toner) will spray onto toned image areas. With use of an AC bi-polar device to recharge the surface having developed image layers thereon, however, the intermediate recharge voltage level should be maintained within a relatively closer range to the background voltage level (e.g. 5"25 volts) of the photoreceptorthan with a monopolar DC device, to ensure that during the development process of subsequent image layers, minimal positive charge will be sprayed onto the previous toned image layers, which could otherwise impair transferability of the composite image.

The voltage profiles on the photoreceptor 10 depicting a single color DAD image forming process step and the intermediate level recharging step of the present invention described with reference to FIG. 1, are illustrated in FIGS. 2A through 2D. FIG. 2A illustrates the voltage profile 68 on photoreceptor belt after the belt has been uniformly charged. The photoreceptor is initially charged to a voltage slightly higher than the −500 volts indicated but after dark decay the $V_{ddp}$ voltage level is −500 volts. After a first exposure at exposure station B and as represented in FIG. 2B, the voltage profile comprises high and low voltage levels 72 and 74, respectively. The level 72 at the original −500 volts represents the charged background area, while the level 74 at −100 volts (FIG. 2B) represents the area discharged by the laser 24 and corresponds to the area to be developed by the developer housing 26.

During the development step, negatively charged colored toner 77 adheres to the DAD image area and causes the photoreceptor in the image area to be negatively increased from −100 volts to approximately −250 volts (FIG. 2*c*). Thus, a voltage difference of −250 volts exists between the toned 73 (−250 volts) and untoned 72 (−500 volts) areas of the photoreceptor.

The recharge device 36 charges the toned areas 73 of the photoreceptor from −250 volts to −475 volts, and reduces the background areas 72 to −475 volts as shown in FIG. 2D. By applying a net charge of +25 volts to the background areas, those wrong charge positive toner particles 78 found thereon remain positively charged and do not vary in charge level so as to become closely associated with the charge level of the image toner. The positively charged background toner is therefore not attracted to the support substrate during image transfer. Use of an AC recharge device ensures that positive ions are sprayed onto the background areas 72, and that negative ions are sprayed onto the image areas 73. By using a bi-polar AC recharge device further ensures that ions sprayed onto image areas will not impair the transferability of the image to a substrate.

FIGS. 3A–3E and 4A–4D are examples of recharging steps used in a DAD image forming process step of the prior art, which would likely demonstrate the occurrence of wrong charge background toner transfer. These systems illustrate the prior art situations where background toner will transfer with the image to the support substrate, and will thereby impair image quality.

Figures 3A, 3B, 3C, 3D, 3E:
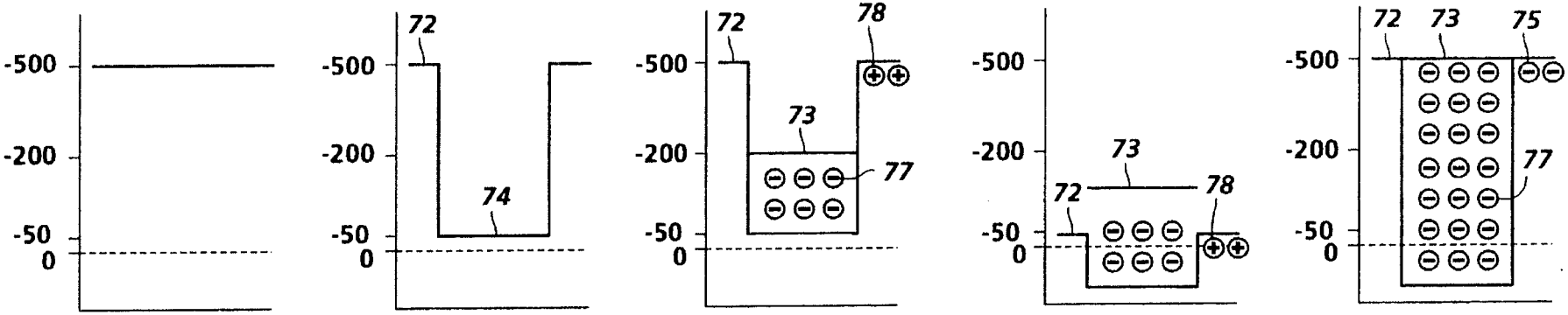
FIG. 3A shows the photoreceptor voltage profile after a uniform charging step of a DAD image formation process of the prior art.
FIG. 3B shows the photoreceptor voltage profile after an exposure step of a DAD image formation process of the prior art.
FIG. 3C shows the photoreceptor voltage profile after a development step of a DAD image formation process of the prior art.
FIG. 3D shows the photoreceptor voltage profile after an erase step of a DAD image formation process of the prior art.
FIG. 3E shows the photoreceptor voltage profile after a recharging step of a DAD image formation process of the prior art.

For example, FIGS. 3A through 3E represent a DAD image formation step wherein, after the exposure step (FIG. 3B) and the development step (FIG. 3C), an erase step (FIG. 3D) is performed, whereby the background areas 72 having positively charged background toner 78, and image regions 73 having negatively charged toner particles 75, are discharged in an attempt to recharge both regions to a substantially uniform level. During recharge (FIG. 3E), the background areas 72 and image areas 73 are recharged to a level corresponding with the original charge level of the photoreceptor (FIG. 3A). However, due to the relatively high level of negative charge needed to recharge the background areas to a uniform level ready for the next color image formation thereon, any positively charged wrong-charge background toner 78 will reverse in polarity and also become negatively charged 75. During a subsequent transfer step, these negative background toner particles 75 will transfer to the support substrate with the negative toner image 73, thereby impairing image quality.

FIGS. 4A through 4D represent another example of a DAD image formation step known in the art which would exhibit the problem of wrong sign background toner transfer. After charging the photoreceptor to an initial high negative level (FIG. 4A), and discharging the image areas to be developed with an exposure device (FIG. 4B), the DAD image area 74 is developed with a negatively charged color toner 77 (FIG. 4C). As shown in FIG. 4D, by recharging both the background areas 72 having positively charged background toner 78, and image areas 73 having negatively charged toner particles 77, of the photoreceptor to a higher negative level than the background regions 72 in an attempt to recharge both the background 72 and toned regions 73 to a substantially uniform level, any positively charged background toner 78 risks reversing in polarity to become negatively charged 75, and therefore transferring with the image to a support substrate in a subsequent transfer step.

While the foregoing description was directed to a DAD$^n$ image on image process color printer where a full color image is built in a single pass of the charge retentive surface, it will be appreciated that the invention may also be used in a CAD$^n$ or DAD$^n$ in either single pass or multiple pass systems, as well as in a single or multiple highlight color process machine.

What is claimed is:

1. A printing machine comprising:

a charge retentive surface having a non-image area of a first voltage level and a developed image area of a second voltage level, a corona generating device for recharging the charge retentive surface to a substantially uniform voltage level intermediate the first voltage level and the second voltage level; and a bi-polar AC voltage applied to said corona generating device for generating corona of a first polarity and of a second polarity;

wherein said corona generating device recharges the charge retentive surface to a voltage level within a range from about 5 volts to about 25 volts of the first voltage level.

2. A method for creating an image on a charge retentive surface, comprising:

charging the charge retentive surface to a first voltage level;

exposing the charge retentive surface to record an image area;

developing the image areas to form a developed image area at a second voltage level with a non-image area being at the first voltage level;

recharging the charge retentive surface to a substantially uniform voltage level intermediate the first voltage level and the second voltage level using a corona generating device driven by a bi-polar AC voltage to the corona recharge device such that the recharge step charges the charge retentive surface to a voltage level within a range from about 5 volts to about 25 volts from the first voltage level.

* * * * *